US008526875B2

(12) United States Patent
Matsuno et al.

(10) Patent No.: US 8,526,875 B2
(45) Date of Patent: Sep. 3, 2013

(54) ROLLER AND HEATING MEMBER CONFIGURATION FOR A FIXING DEVICE AND AN IMAGE FORMING APPARATUS

(75) Inventors: Takuji Matsuno, Ichinomiya (JP); Kenji Takeuchi, Nagoya (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 266 days.

(21) Appl. No.: 13/070,040

(22) Filed: Mar. 23, 2011

(65) Prior Publication Data

US 2011/0262195 A1 Oct. 27, 2011

(30) Foreign Application Priority Data

Apr. 27, 2010 (JP) ..... 2010-102435

(51) Int. Cl.
*G03G 15/00* (2006.01)

(52) U.S. Cl.
USPC ..... 399/405

(58) Field of Classification Search
USPC ..... 399/405, 335, 381
See application file for complete search history.

(56) References Cited

U.S. PATENT DOCUMENTS

| | | | | |
|---|---|---|---|---|
| 5,870,662 | A * | 2/1999 | Tomatsu | 399/406 |
| 6,330,419 | B1 * | 12/2001 | Sano et al. | 399/322 |
| 2004/0018034 | A1 * | 1/2004 | Baek et al. | 399/405 |
| 2005/0220520 | A1 * | 10/2005 | Kawamoto | 399/405 |
| 2010/0247196 | A1 * | 9/2010 | Ichiki et al. | 399/381 |

FOREIGN PATENT DOCUMENTS

| | | | |
|---|---|---|---|
| JP | 4242777 | A | 8/1992 |
| JP | 05-058527 | A | 3/1993 |
| JP | 10-279098 | A | 10/1998 |
| JP | 10-289543 | A | 10/1998 |
| JP | 2002-362808 | A | 12/2002 |
| JP | 2003-063685 | A | 3/2003 |
| JP | 2006-103871 | A | 4/2006 |
| JP | 2006-234856 | A | 9/2006 |
| JP | 2008-209642 | A | 9/2008 |
| JP | 2008-273648 | A | 11/2008 |
| JP | 2009227437 | A | 10/2009 |

OTHER PUBLICATIONS

Notification of Reasons for Refusal for Japanese patent application No. 2010-102435 mailed Mar. 13, 2012.
Japanese Decision to Grant received in corresponding Japanese Application No. 2010-102435 mailed on Nov. 6, 2012.

* cited by examiner

*Primary Examiner* — G. M. Hyder
(74) *Attorney, Agent, or Firm* — Banner & Witcoff, Ltd.

(57) ABSTRACT

A fixing device includes: a frame forming a transport path; a heating member disposed on the transport path; first and second transport rollers which are disposed so as to face the heating member in the transport direction and hold the recording sheet between the first and second transport rollers to transport the recording sheet, the first transport roller including a rotation shaft; and a spring which includes a holding portion holding the rotation shaft of the first transport roller, a support portion supported by the frame and an arm part between the holding portion and the support portion, and is configured to bias the transport roller to the second transport roller; and a restriction portion which contacts a part of the spring between the holding portion and the support portion and restricts the first transport roller from being moved in a direction separated from the second transport roller.

5 Claims, 7 Drawing Sheets

ROLLER AND HEATING MEMBER CONFIGURATION FOR A FIXING DEVICE AND AN IMAGE FORMING APPARATUS

This application is based upon and claims the benefit of priority of Japanese Patent Application No. 2010-102435 filed on Apr. 27, 2010, the contents of which are incorporated herein by reference in its entirety.

BACKGROUND

The present invention relates to a fixing device including a pair of transport rollers that is disposed so as to face a heating member, and an image forming apparatus including the fixing device.

Hitherto, as a fixing device, a device has been known which has a configuration in which, in a downstream side of a paper transport direction of a heating roller (a heating member), a pair of transport rollers for transporting a paper is disposed so as to close a paper transport path. In the technique, one transport roller can move to a certain extent relative to another transport roller in a thickness direction of the paper.

SUMMARY

However, in the configuration of the related art, upon removing a paper jammed between the pair of transport rollers (at the time of jam handling), when one transport roller moves in the paper thickness direction more than necessary to greatly open the paper transport path, there is a concern that foreign objects will enter the paper transport path and become attached to a heating member, whereby an image quality may decline. In addition, it is considered that a movement amount of one transport roller is restricted so that a gap between the pair of transport rollers does not increase in size. However, in the case of bringing the transport rollers themselves into contact with the restriction member to restrict the movement, since the restriction member should be provided on the opposite side of the other transport roller with one transport roller interposed therebetween, there is a problem in that the device becomes larger.

Thus, an object of the present invention is to suppress the foreign matter from entering the heating member at the time of jam handling, while suppressing the device from becoming larger.

An aspect of the disclosure provides the following arrangement.

A fixing device comprising:

a frame forming a transport path for transporting a recording sheet in a transport direction;

a heating member that is disposed on the transport path and thermally fixes a developer image on the recording sheet;

first and second transport rollers which are disposed so as to face the heating member in the transport direction and hold the recording sheet between the first and second transport rollers to transport the recording sheet, the first transport roller including a rotation shaft;

a spring which includes a holding portion holding the rotation shaft of the first transport roller at one end side of the spring, a support portion supported by the frame at the other side of the spring and an arm part between the holding portion and the support portion, and is configured to bias the transport roller to the second transport roller; and a restriction portion which contacts a part of the spring between the holding portion and the support portion and restricts the first transport roller from being moved in a direction separated from the second transport roller.

DESCRIPTION OF EXEMPLARY EMBODIMENTS

Next, an embodiment of the present invention will be described in detail with reference to suitable drawings. In addition, in the following description, firstly, after briefly describing the whole configuration of a laser printer as an example of an image forming apparatus, details of characteristic portions of the present invention will be described in detail.

Furthermore, in the following description, directions referring to a user at the time of using a laser printer will be described. That is, in FIG. 1, a right side is called "a front side (a head side)", a left side is called "a rear side (inside)", and an inside in a paper surface vertical direction is called "a right side" and a head side in the paper surface vertical direction is called "a left side". Furthermore, an up-to-down direction toward the paper surface is called "an up-to-down direction".

<Whole Structure of Laser Printer>

Figure 1:
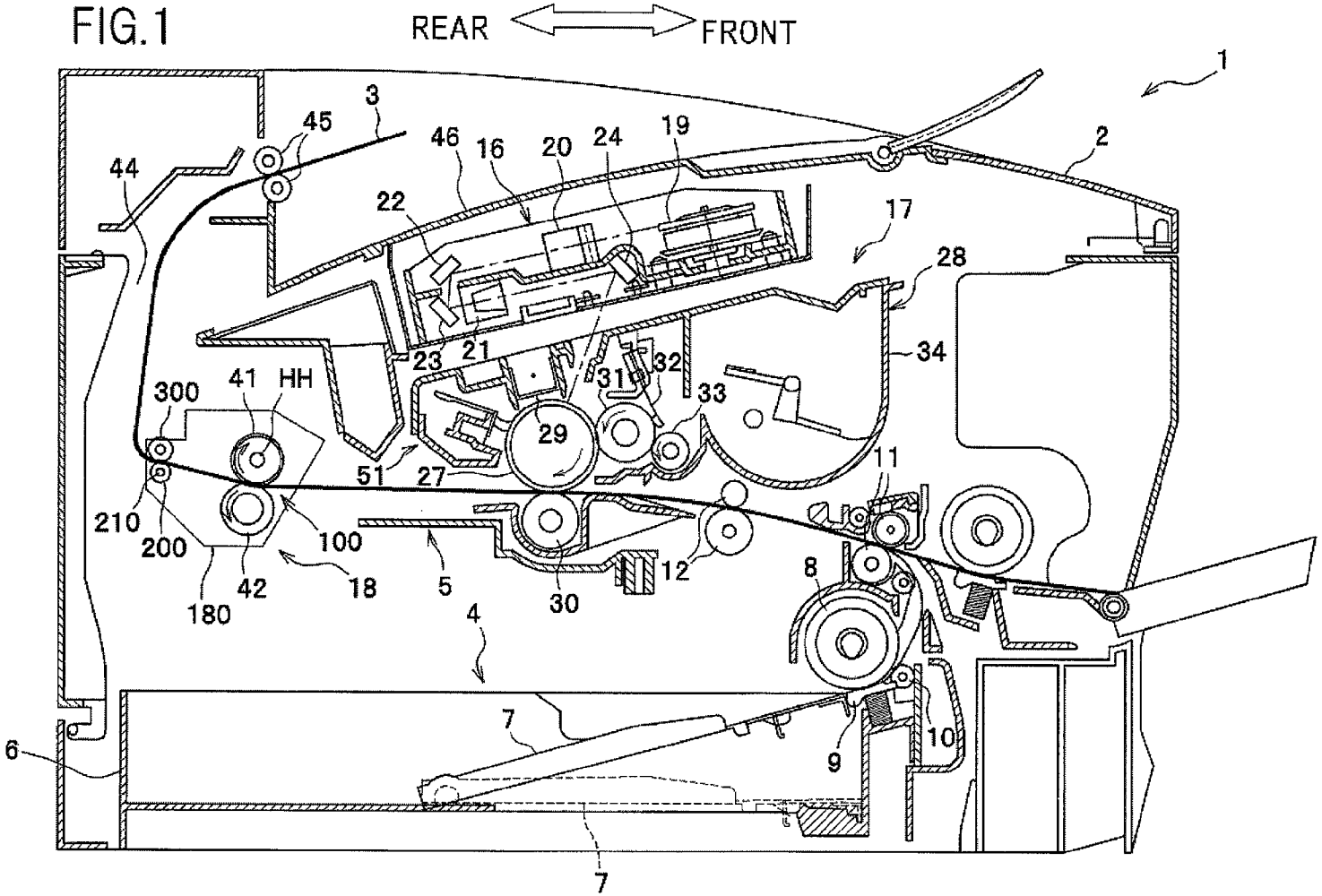
FIG. 1 is a side cross-sectional view that shows a laser printer according to an embodiment of the present invention.

As shown in FIG. 1, a laser printer 1 includes a filter portion 4 for feeding a paper 3 as an example of a recording sheet into a device main body 2, an image forming portion 5 for forming an image on the fed paper 3 or the like.

The filter portion 4 includes a paper feeding tray 6 that is mounted on a bottom portion in the device main body 2 in an attachable and detachable manner, and a paper pressing plate 7 that is provided in the paper feeding tray 6. Furthermore, the filter portion 4 includes a paper feeding roller 8 and a paper feeding putt 9 provided in an upper part of a front end portion of the paper feeding tray 6, and paper powder grasping rollers 10 and 11 provided in a downstream side of a transport direction of the paper 3 with respect to the paper feeding roller 8. Moreover, the filter portion 4 includes a resist roller 12 provided in a downstream side with respect to the paper powder grasping rollers 10 and 11.

Moreover, in the filter portion 4 configured as above, the papers 3 within the paper feeding tray 6 are made to approach the paper feeding roller 8 by the paper pressing plate 7, are delivered by the paper feeding roller 8 and the paper feeding putt 9, pass through the respective rollers 10 to 12 and then are transported to the image forming portion 5 one by one.

The image forming portion 5 includes a scanner portion 16, a process cartridge 17, a fixing device 18 or the like.

The scanner portion 16 is provided on an upper portion in the device main body 2 and includes a laser light emitting portion (not shown), a polygon mirror 19 that is rotated and driven, lenses 20 and 21, reflectors 22, 23 and 24 or the like. Moreover, in the scanner portion 16, a laser beam is scanned and irradiated on a surface photosensitive drum 27 of the process cartridge 17 through a path shown by dotted lines in the drawing at a high speed.

The process cartridge 17 is arranged on a lower part of the scanner portion 16 and is mounted on the device main body 2 in a freely attachable and detachable manner. Moreover, the process cartridge 17 is mainly constituted by a developing cartridge 28 and a drum cartridge 51.

The developing cartridge 28 includes a developing roller 31, a layer thickness restriction blade 32, a supply roller 33 and a toner hopper 34. Moreover, the toner in the toner hopper 34 is stirred by an agitator (not shown) and then is supplied to the developing roller 31 by the supply roller 33, and, at this time, the toner is correctly frictionally electrified between the supply roller 33 and the developing roller 31. The toner supplied onto the developing roller 31 enters between the layer thickness restriction blade 32 and the developing roller 31 due to the rotation of the developing roller 31, and is carried on the developing roller 31 as a thin layer of a fixed thickness.

The drum unit 51 mainly includes a photosensitive drum 27, a charger 29 and a transfer roller 30. Moreover, in the drum unit 51, a surface of the photosensitive drum 27 is similarly positively electrified by the charger 29 and then is exposed by the high speed scanning of the laser beam from the scanner portion 16. As a result, an electric potential of the exposed portion is lowered, whereby an electrostatic latent image based on the image data is formed. Next, when the toner carried on the developing roller 31 contacts the photosensitive drum 27 due to the rotation of the developing roller 31, the toner is supplied to the electrostatic latent image formed on the surface of the photosensitive drum 27. Moreover, the toner becomes a visible image by being selectively carried on the surface of the photosensitive drum 27, whereby the toner image is formed by a solarization.

Thereafter, the photosensitive drum 27 and the transfer roller 30 are rotated and driven so as to interpose the paper 3 therebetween and transport the same, and the paper 3 is transported between the photosensitive drum 27 and the transfer roller 30, whereby the toner image carried on a rear surface of the photosensitive drum 27 is transferred onto the paper 3.

The fixing device 18 mainly includes a halogen heater HH, a heating roller 41 as an example of a heating member, a pressurization roller 42, and two transport rollers 200 and 300.

The halogen heater HH is arranged in a cylindrical heating roller 41 and heats the heating roller 41 from the inside thereof.

The heating roller 41 is a roller for thermally fixing the toner on the paper 3 and is disposed on the transport path 100 in the fixing device 18. Specifically, the heating roller 41 is a metallic member formed in approximately a cylindrical shape, and is rotatably supported on the frame 180 of the fixing device 18. In addition, as the heating roller 41, for example, it is possible to adopt one in which a surface of a cylinder member of aluminum is subjected to a PTFE coating.

The pressurization roller 42 is pressed on the heating roller 41 by a spring (not shown), contacts the rotating heating roller 41, and is rotated accordingly. In addition, as the pressurization roller 42, for example, it is possible to adopt one in which a urethane rubber is provided around a core metal and the surface of urethane rubber is coated with a PTFE tube.

The transport rollers 200 and 300 are disposed so as to face the heating roller 41 in the transport direction in a position of the downstream side in the transport direction of the heating roller 41, and are rotatably supported on the frame 180 of the fixing device 18. Moreover, the driving force is input to any one roller, whereby the transport rollers 200 and 300 interpose the paper 3 therebetween and transport the paper 3 to the rear part. In addition, the structures around the transport rollers 200 and 300 will be described later in detail.

Moreover, in the fixing device 18 configured as above, the heating roller 41 is heated by the halogen heater HH, whereby the toner image transferred on the paper 3 when the paper 3 passes between the heating roller 41 and the pressurization roller 42 is thermally fixed. Thereafter, the paper 3 is transported to a paper discharging path 44 by the transport rollers 200 and 300. In addition, the paper 3 transported to the paper discharging path 44 is discharged onto a paper discharging tray 46 by the paper discharging roller 45.

<Structure Around Transport Rollers>

Next, a structure around the transport rollers 200 and 300 will be described in detail.

Figure 2:
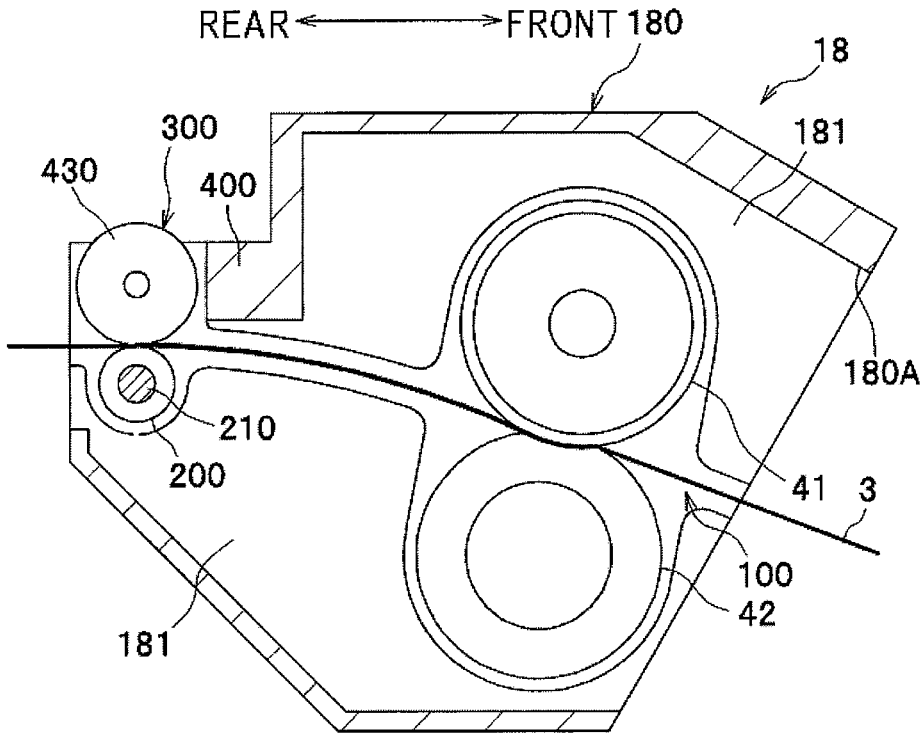
FIG. 2 is an explanatory diagram that simply shows a fixing device.

As shown in FIG. 2, the transport rollers 200 and 300 are disposed in a row up and down so as to close an exit on the transport path 100 for transporting the paper 3 formed on the frame 180, specifically, an exit of a downstream side of the transport direction of the transport path 100. Herein, the transport path 100 is formed by a plurality of plate-shaped ribs 181 arranged in a left to right direction (a width direction of the paper 3).

Figure 3A:
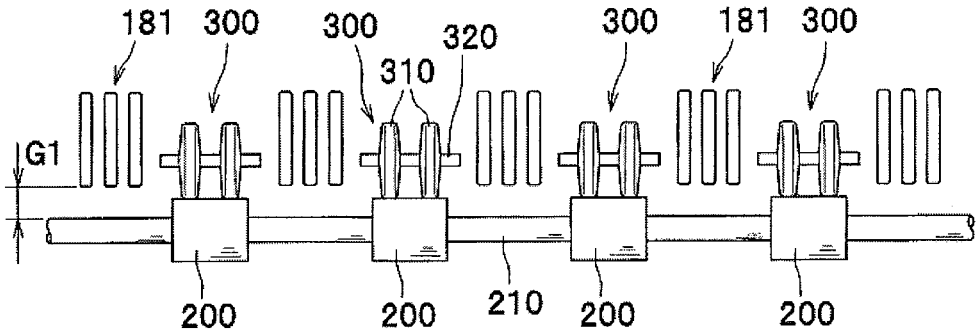
FIG. 3A is an explanatory diagram in which a pair of transport rollers is viewed from a downstream side of a paper transport direction.

As shown in FIG. 3A, a plurality of transport rollers 200 and 300 is arranged along the left to right direction at predetermined gaps, and a lower (the other side) transport roller 200 is supported on a shaft portion 210 extending from left to right and can be rotated integrally therewith. Moreover, the shaft portion 210 is formed to have a diameter smaller than that of the transport roller 200 and is rotatably supported on the frame 180.

Figure 4:
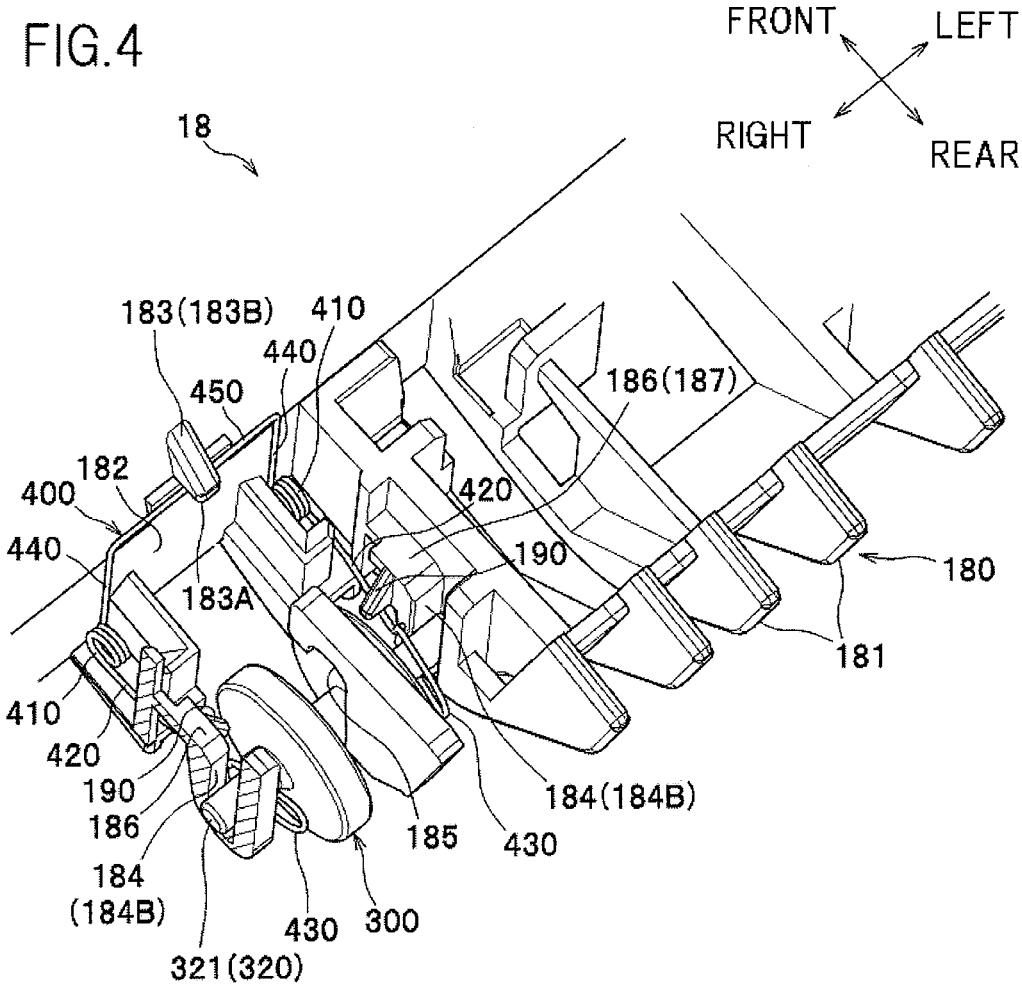
FIG. 4 is a perspective view in which a part is cut away in order to show a structure around an upper transport roller, a torsion spring and a transport roller of a frame.

An upper (one side) transport roller 300 includes two disk-type roller portions 310, and rotation shafts 320 that are formed integrally with the respective roller portions 310 so as to penetrate the centers of the respective roller portions 310. Moreover, as shown in FIG. 4, both end portions 321 of the rotation shafts 320 are rotatably supported by the torsion spring 400 (specifically, a holding portion 430 described later), and the transport roller 300 is biased to the lower transport roller 200 by the torsion spring 400.

The torsion spring 400 includes a pair of coil portions 410, a pair of arm portions 420, a pair of holding portions 430, a pair of spring leg portions 440, and one support portion 450, and is formed to have approximately an L shape when viewed from the left to right direction and approximately an U shape when viewed from the up to down direction.

The respective coil portions 410 are coiled in a coil shape around an axis along the left to right direction and are disposed separately from each other so that a predetermined gap is empty in a left to right direction.

The arm portion 420 is formed so as to extend along approximately the front to rear direction (approximately the transport direction) from the coil portion 410 toward the transport roller 300, whereby the arm portion 420 can oscillate in the up to down direction around the coil portion 410 (a part).

The holding portion 430 is formed (supported) integrally on the front end (one end side) of the arm portion 420, and is bent and formed in approximately a circular ring shape so as to surround the end portion of the rotation shaft 320 of the transport roller 300. That is, the holding portion 430 is formed in a ring shape which forms an elongated hole which is long approximately in the front to rear direction so as to support the rotations shaft 320 movably (see FIG. 5B).

The respective spring leg portions 440 extend in a direction (approximately the up to down direction) different from those from the respective coil portions 410 to the arm portions 420, and the respective front end portions thereof are integrally connected by the support portion 450.

The support portion 450 is disposed in an opposite side (the other end side) of the holding portion 430 with the coil portion 410 interposed therebetween, and is extended and formed in the left to right direction so as to bind the front ends of the respective spring leg portions 440. Moreover, the support portion 450 is pressed and supported to a support wall 182 which is formed in the frame 180 by a biasing force of the torsion spring 400 of the time when the torsion spring 400 is attached to the frame 180 (the movement to the front is restrained: see FIG. 5B).

Furthermore, in the support wall 182, on a position further up than the support portion 450 of the mounted torsion spring 400, a protrusion portion 183 which, restricts the movement to the upper part of the support portion 450, is formed so as to protrude rearward.

Figure 5A:
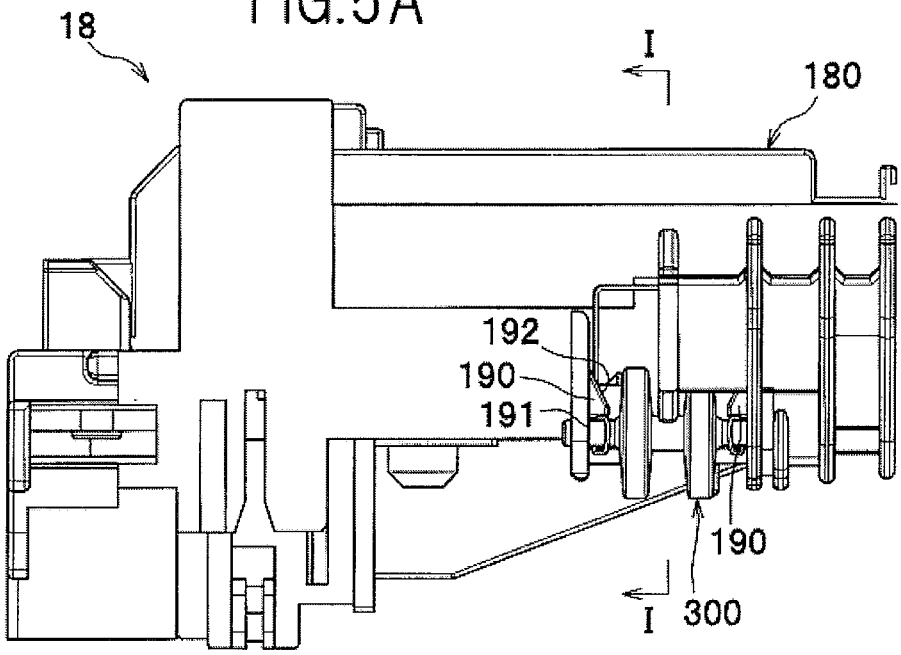
FIG. 5A is a rear view viewing the structure of FIG. 4 from the rear.
Figure 5B:
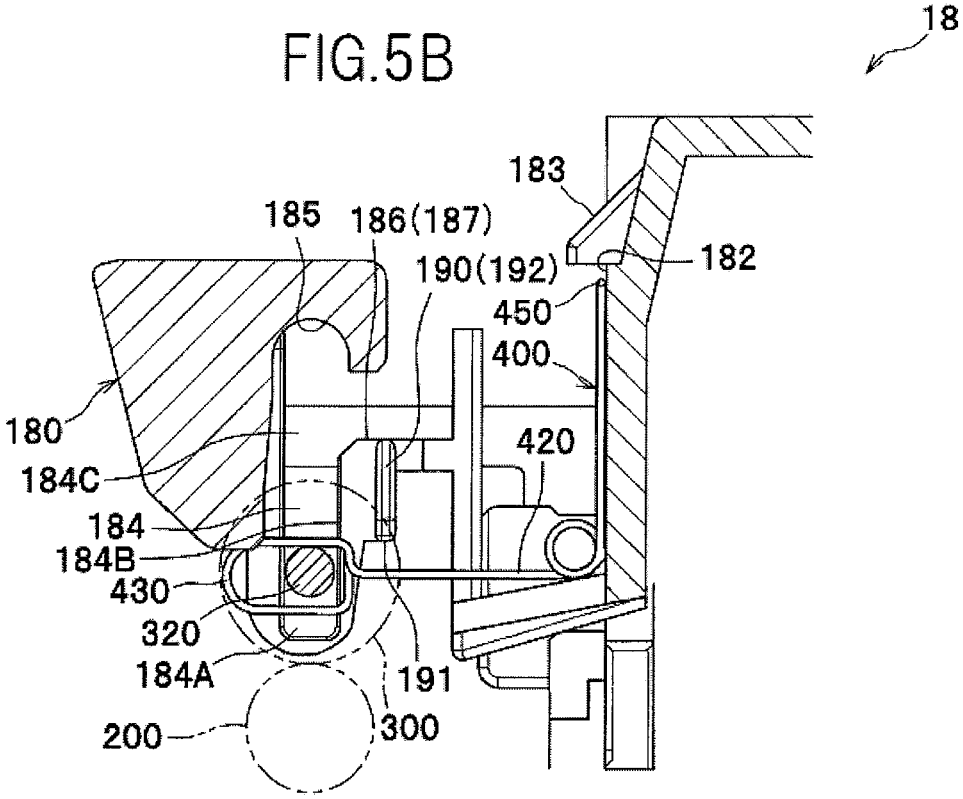
FIG. 5B is a cross-sectional view cut away along lines I-I of FIG. 5A.

Furthermore, as shown in FIGS. 4, 5A and 5B, on the frame 180, a pair of restriction portions 190 is formed which is disposed on the upper part of the respective arm portions 420 (the position between the holding portion 430 and the support portion 450) of the mounted torsion spring 400, and can contacts the respective arm portions 420 from above. Specifically, the lower surfaces of the respective restriction portions 190 are restriction surfaces 191 that contact the arm portions 420 to restrict the movement of the upper transport roller 300.

Figure 6A:
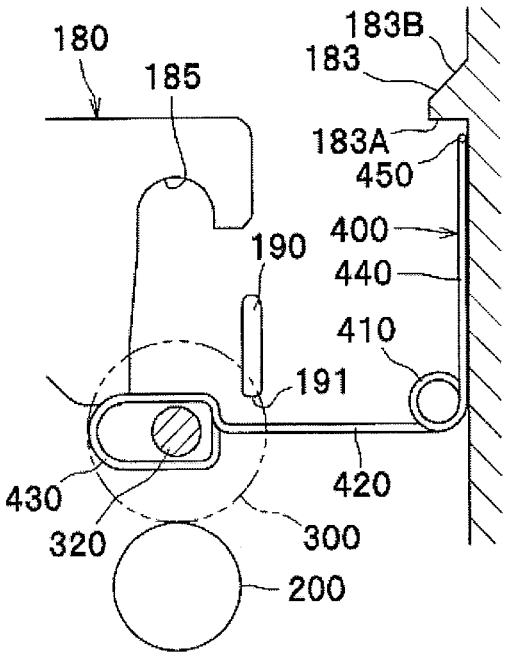
FIGS. 6A to 6D are explanatory diagrams that show operations when a force facing upward is applied to the transport roller at the time of jam handling.
Figure 6B:
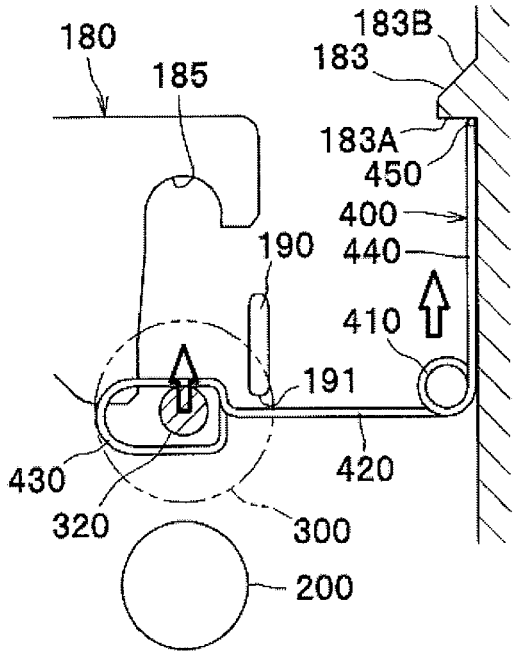

As a result, as shown in FIGS. 6A and 6B, at the time of the jam handling, when the upper transport roller 300 is moved to the upper part (a direction separated from the lower transport roller 200), firstly, the torsion spring 400 is also moved together with the transport roller 300, and the support portion 450 of the torsion spring 400 contacts the protrusion portion 183, whereby the movement of the support portion 450 of the torsion spring 400 is restrained by the protrusion portion 183.

Figure 6C:
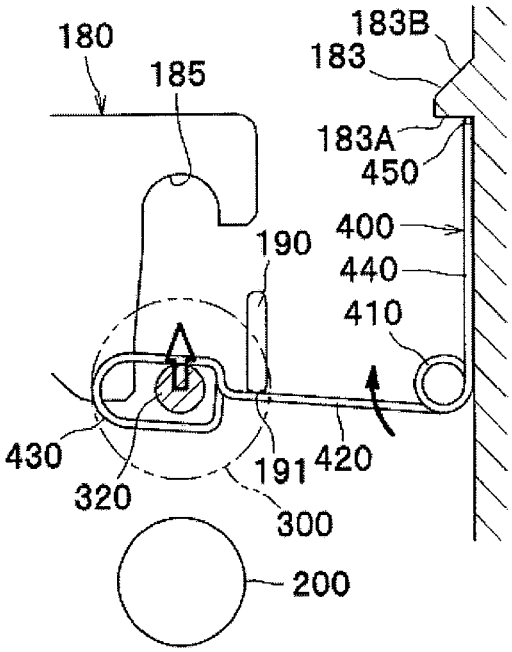

Thereafter, when an upward force is applied to the upper transport roller 300, the upper transport roller 300 is moved to the upper part in resistance to the biasing force of the torsion spring 400. That is, the arm portion 420 of the torsion spring 400 rolls to the upper part around the coil portion 410, but, as shown in FIG. 6C, when the arm portion 420 contacts the restriction portion 190 (the restriction surface 191), the movement of the transport roller 300 in excess of that is prevented, which makes it possible to actively reduce a gap between the pair of transport rollers 200 and 300.

Furthermore, as shown in FIGS. 5A and 5B, in the respective restriction portions 190, tilt surfaces 192, which are disposed at a side of the restriction portions 190 opposite to the lower transport roller 200 with the above-mentioned restriction surface 191 interposed therebetween and tilted with respect to the restriction surface 191, are formed consecutively with the restriction surface 191. Specifically, the respective tilt surfaces 192 are formed so as to be tilted to the inside (a direction approaching each other) of the left to right direction as they face downward.

Figure 7A:
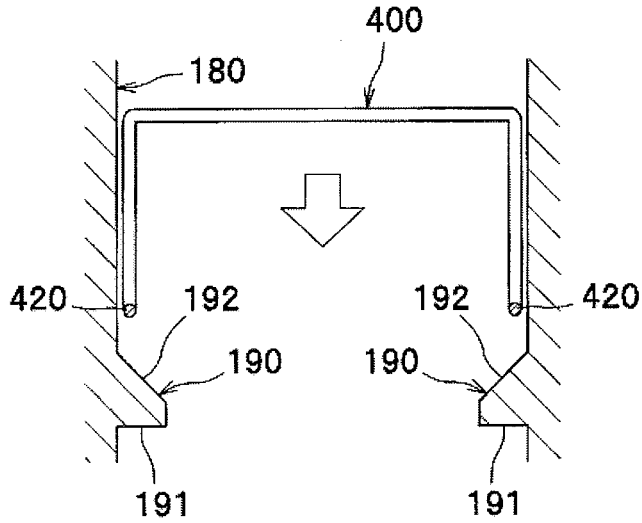
FIGS. 7A to 7C are explanatory diagrams that show operations in which an arm portion of the torsion spring is guided to a restriction surface in a tilt surface of a restriction portion.
Figure 7B:
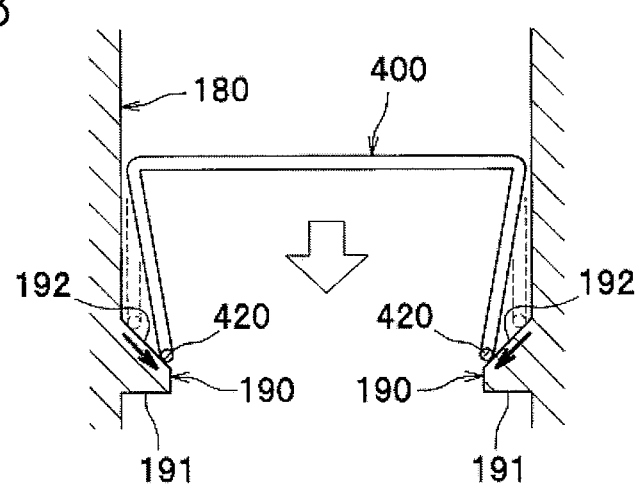
Figure 7C:
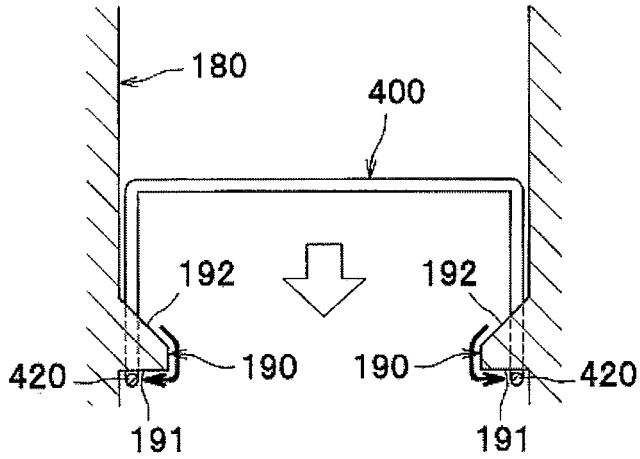

As a result, as shown in FIGS. 7A to 7C, at the time of the attachment of the torsion spring 400 to the frame 180, it is possible to guide the pair of arm portions 420 to the restriction surface 191 while bending-deforming the arm portions 420 in the direction approaching each other by the respective tilt surfaces 192.

That is, when the pair of arm portions 420 is moved up to the lower ends of the respective tilt surfaces 192 in the direction approaching each other while being bending-deformed, and climbs over the lower end (angular portion), due to the return force of the torsion spring 400, the pair of arm portions 420 returns to an original posture and thus is disposed in the lower part of the restriction surface 191. For that reason, the work of putting the respective arm portions 420 in the lower sides of the respective restriction portions 190 becomes easier.

In addition, as shown in FIG. 4, the protrusion portion 183 formed on the frame 180 is also formed to have a triangular cross-section that is approximately the same as that of the restriction portion 190, and includes a stopper surface 183A which restricts the movement of the support portion 450 of the torsion spring 400, and a tilt surface 183B which is tilted with respect to the stopper surface 183A so as to guide the support portion 450 in the stopper surface 183A. As a result, the work of putting the support portion 450 in the lower side of the protrusion portion 183 also becomes easier.

Furthermore, as shown in FIG. 4, on the frame 180, a pair of support grooves 184 is formed which extends along the up to down direction (the movement direction of the upper transport roller 300) and movably supports both end portions 321 of the rotation shaft 320 of the upper transport roller 300. The respective support grooves 184 are formed so that the upper sides thereof (opposite side of the lower transport roller 200) are opened.

Figure 6D:
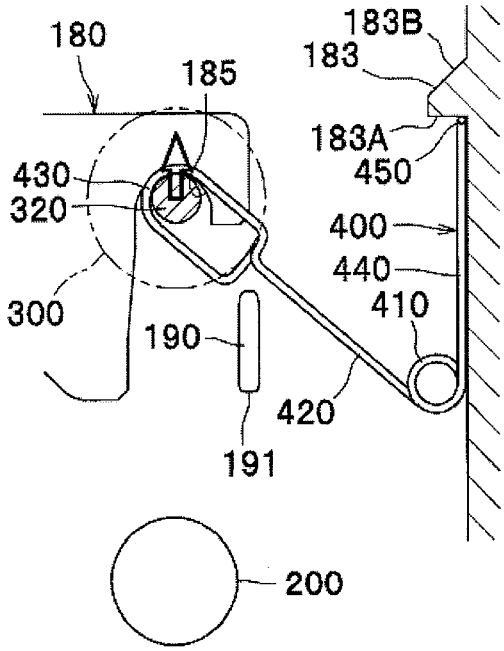

Moreover, as shown in FIGS. 4 and 5B, in a side (first side) of the support groove 184 opposite to the lower end portion 184A (the end portion of the lower transport roller 200 side) with the restriction portion 190 interposed therebetween, and in a position which deviates from the support groove 184 in the left to right direction (the axial direction of the rotation shaft 320), a U-shaped concave portion 185 opening to the lower part is provided. As a result, as shown in FIG. 6D, a strong force is applied to the transport roller 300 at the time of the jam handling, whereby even when the arm portion 420 of the torsion spring 400 is removed from the restriction portion 190, it is possible to receive and accommodate the rotation shaft 320 of the transport roller 300 moving to the upper part at the concave portion 185.

That is, if the concave portion 185 is not provided, the movement of the transport roller 300 to the upper part is not stopped, and the transport roller 300 falls out from the support groove 184. However, by providing the concave portion 185 as in the present embodiment, it is possible to suppress the falling-out of the transport roller 300 from the support groove 184. Furthermore, since the concave portion 185 is provided in a position which deviates from the support groove 184 in the left to right direction, as compared to a case where the up and down end portions of the support groove are formed so as to be closed at both sides, the mold release at the time of molding the frame 180 formed of resin becomes easier.

Furthermore, as shown in FIGS. 4 and 5B, in the vicinity of the support groove 184 of the frame 180, a guidance surface 186 is formed which is consecutively formed on the inner surface 184B of the support groove 184 so as to guide the rotation shaft 320 into the support groove 184 at the time of attaching the upper transport roller 300 to the frame 180. Specifically, the guidance surface 186 is formed so as to extend in a direction approximately orthogonal to the support groove 184 in a position further up from the restriction portion 190 (an opposite side of the lower transport roller 200).

Herein, in FIG. 4, in order to simply and easily show the structure of the support groove 184, the right support groove 184 is shown so as to be penetrated from left to right, but, in practice, even in the right side of the right support groove 184, a transporting rib 181 or the like is formed.

In other words, as shown in FIG. 5B, in the open upper end portion 184C of the support groove 184, a guidance groove 187 is consecutively formed which is opened toward the inside of the upper part and the left to right direction (a middle side of the transport roller 300 in the axial direction) and extends in the front to rear direction (the transport direction). Moreover, the lower surface of the guidance groove 187 is the above-mentioned guidance surface 186.

In this manner, the guidance surface 186 is formed so as to extend in the direction approximately orthogonal to the support grove 184, whereby, even when the arm portion 420 is removed from the restriction portion 190 at the time of the jam handling, the rotation shaft 320 does not easily fall out along the guidance surface 186 (the mounting path of the rotation shaft 320) to the outside.

Furthermore, as shown in FIG. 3A, the transporting rib 181, which is disposed so as to face the shaft portion 210 of the lower transport roller 200 in the up to down direction, is disposed so that a predetermined gap G1 is empty between it and the shaft portion 210. Herein, the rib 181 facing the shaft portion 210 corresponds to an example of the wall portion.

Figure 3B:
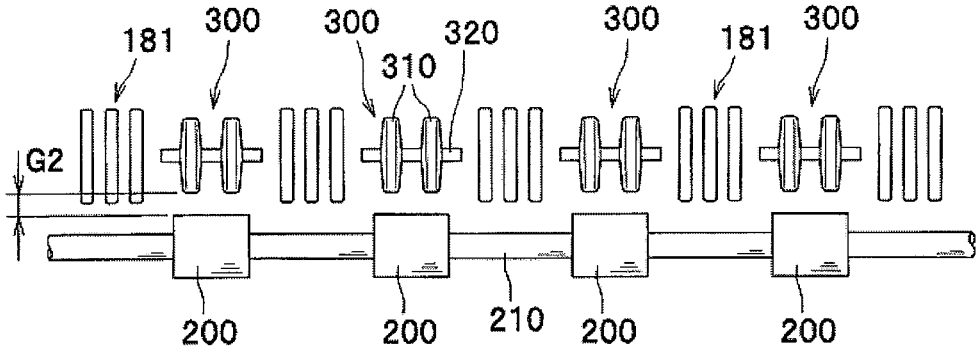
FIG. 3B is an explanatory diagram that shows a gap between the pair of transport rollers when a torsion spring is restricted by a restriction portion.

On the contrary to this, as shown in FIG. 3B, when the arm portion 420 is restricted by the restriction portion 190 at the time of the jam handling, a gap G2 between the pair of transport rollers 200 and 300 is smaller than the above-mentioned gap G1.

That is, in a position where the gap G2 of the time when the portion between two transport rollers 200 and 300 is widened until the torsion spring 400 contacts the restriction portion 190 is smaller than the gap G1 between the shaft portion 210 and the rib 181, the restriction portion 190 is provided. As a result, it is possible to further suppress the foreign matter from entering from the gap between the pair of transport rollers 200 and 300.

As described above, in the present embodiment, the following effects can be obtained.

The torsion spring 400 contacts the restriction portion 190 at the time of the jam handling, whereby the movement of the upper transport roller 300 is restricted. Thus, it is possible to reduce the gap between the pair of transport rollers 200 and 300.

Furthermore, since the torsion spring 400 contacts the restriction portion 190 to restrict the movement, for example, as compared to the structure in which the disk-shaped roller portion 310 of the transport roller 300 contacts the restriction portion to restrict the movement, the restriction portion 190 can be disposed in a lower position, and the size of the restriction portion 190 can also be formed to be small to suit the torsion spring 400, and thus, miniaturization and weight-reduction of the fixing device 18 can be accomplished.

Since the restriction portion 190 contacts the arm portion 420 of the torsion spring 400, that is, the restriction portion 190 contacts a part having an oscillating range smaller than the transport roller 300 (the holding portion 430) having a great oscillating range, the fixing device 18 can be miniaturized.

Since the tilt surface 192 is provided on the restriction portion 190, it is possible to easily perform the attachment of the torsion spring 400 to the frame 180.

Since the concave portion 185 is provided on the side of the support groove 184 opposite to the lower end portion 184A with the restriction portion 190 interposed therebetween, even when the torsion spring 400 is removed from the restriction portion 190, it is possible to suppress the falling-out of the transport roller 300 from the support groove 184.

Furthermore, since the concave portion 185 is disposed in a position which deviates from support groove 184 in the axial direction of the rotation shaft 320 and the support groove 184 is opened to the upper part, as compared to a case where the up and down end portions of the support groove are closed in both sides, it is possible to easily perform the mold release at the time of molding the frame 180 made of resin.

Since the guidance surface 186 is extended in the direction approximately orthogonal to the support groove 184, even when the torsion spring 400 is removed from the restriction portion 190 at the time of the jam handling, it is possible to suppress the rotation shaft 320 from falling out along the guidance surface 186 (the mounting path of the rotation shaft 320) to the outside.

Since the gap G2 of the time when the portion between two transport rollers 200 and 300 is widened until being restricted by the restriction portion 190 is smaller than the gap G1 between the shaft portion 210 and the rib 181, it is possible to suppress the foreign matter from entering from the gap between the pair of transport rollers 200 and 300.

In addition, the present invention is not limited to the above-mentioned embodiment but can be used in various formations as described below as an example.

In the above-mentioned embodiment, as an example of the recording sheet, the paper 3 such as a thick paper, a postcard, and a thin paper was adopted, but the present invention is not limited thereto, for example, the recording sheet may be an OHP sheet.

In the above-mentioned embodiment, the heating roller 41 was adopted as the heating member, but the present invention is not limited thereto, for example, the heating member may be a ceramic heater which heats the recording sheet via a cylindrical fixing film.

In the above-mentioned embodiment, the torsion spring 400 was adopted as the spring, but the present invention is not limited thereto, for example, the spring may be a leaf spring, a coil spring or the like. Furthermore, in the above-mentioned embodiment, the torsion spring 400 was adopted which has two holding portions 430 supporting both end portions 321 of the rotation shaft 320 of the transport roller 300, but the present invention is not limited thereto, for example, a torsion spring may be adopted which has only one holding portion supporting the middle portion of the rotation shaft.

In the above-mentioned embodiment, the arm portion 420 was configured so that it can oscillate around the coil portion 410, but the present invention is not limited thereto, for example, in the case of a V-shaped leaf spring, the arm portion may oscillate around the angular portion of the V shape. Furthermore, the part of the spring contacting the restriction portion is not limited to the arm portion, for example, in the case of the coil spring, the restriction portion can contact a part of the portion that is coiled in a coil shape.

In the above-mentioned embodiment, the plurality of ribs 181 was adopted as an example of the wall portion facing the shaft portion 210 of the lower transport roller 200, but the present invention is not limited thereto, it is possible to adopt wall portions of various shapes. Furthermore, the frame forming the transport path or the frame supporting the support portion of the spring may be one body or separate bodies.

In the above-mentioned embodiment, two transport rollers 200 were provided, but the present invention is not limited thereto as long as at least two transport rollers are provided, for example, three or more transport rollers may be provided. Furthermore, two transport rollers may be two guidance rollers in which the driving force is not input only by guiding the paper on both sides.

In the above-mentioned embodiment, the present invention was applied to the laser printer 1, but the present invention is not limited thereto, the present invention may be applied to other image forming apparatus, for example, a copier, a combiner or the like.

In the above-mentioned embodiment, the halogen heater HH was adopted as an example of the heat source, but the present invention is not limited thereto, for example, an induction heating type of IH (Induction Heating) heater, a heating resistor or the like may be adopted.

What is claimed is:

1. A fixing device comprising:

a frame forming a transport path for transporting a recording sheet in a transport direction;

a heating member disposed on the transport path and configured to thermally fix a developer image on the recording sheet;

first and second transport rollers disposed downstream of the heating member in the transport direction and configured to hold the recording sheet between the first and second transport rollers to transport the recording sheet, the first transport roller including a rotation shaft;

a spring including a holding portion holding the rotation shaft of the first transport roller at one end side of the spring, a support portion supported by the frame at the other side of the spring and an arm part between the holding portion and the support portion, and configured to bias the transport roller to the second transport roller; and a restriction portion configured to contact the arm part of the spring between the holding portion and the support portion and to restrict the first transport roller from being moved in a direction of separation from the second transport roller, wherein the arm part is configured to support the holding portion to allow the holding portion to oscillate around a portion of the arm part, wherein a pair of support grooves, extending along a movement direction of the first transport roller and configured to movably support both end portions of the rotation shaft of the first transport roller, are formed on the frame, wherein a concave portion, configured to receive the rotation shaft of the first transport roller moving in the direction of separation from the second transport roller, is provided at a first side of the support groove while the second transport roller is disposed at a second side of the support groove with the restriction portion interposed between the first and second sides of the support groove, and wherein a guidance surface, which is consecutively formed on an inner surface of the support groove so as to guide the rotation shaft into the support groove, is formed in a position between the first side of the support groove side and the restriction portion so as to extend in a direction approximately orthogonal to the support groove.

2. The fixing device according to claim 1, wherein the restriction portion includes:

a restriction surface configured to contact the arm part to restrict the movement of the first transport roller; and a tilt surface tilted with respect to the restriction surface, and configured to guide the arm part to the restriction surface by bending and deforming the arm part at the time of attaching the spring to the frame.

3. The fixing device according to claim 1, wherein the second side of the support groove is formed so as to be opened, and wherein the concave portion is disposed so as to deviate with respect to the support groove in the axial direction of the rotation shaft.

4. The fixing device according to claim 1, wherein a shaft portion configured to support the second transport roller is provided on the second transport roller, a wall portion facing the shaft portion is provided on the frame, and the restriction portion is provided in a position where a gap between the first and second transport roller at the time when a portion between the first and second transport rollers is widened until the spring comes into contact with the restriction portion is smaller than a gap between the shaft portion and the wall portion.

5. An image forming apparatus including the fixing device according to claim 1.

* * * * *